US008925790B1

(12) United States Patent
Edel

(10) Patent No.: US 8,925,790 B1
(45) Date of Patent: Jan. 6, 2015

(54) METHOD FOR ATTACHING THE HOSEL TO A PUTTER HEAD

(76) Inventor: David Edel, Liberty Hill, TX (US)

( * ) Notice: Subject to any disclaimer, the term of this patent is extended or adjusted under 35 U.S.C. 154(b) by 271 days.

(21) Appl. No.: 13/409,995

(22) Filed: Mar. 1, 2012

Related U.S. Application Data

(60) Provisional application No. 61/447,771, filed on Mar. 1, 2011.

(51) Int. Cl.
*B23K 31/02* (2006.01)
*A63B 53/02* (2006.01)

(52) U.S. Cl.
USPC ..... 228/101; 228/165; 228/174; 473/282

(58) Field of Classification Search
None
See application file for complete search history.

(56) References Cited

U.S. PATENT DOCUMENTS 1,983,069 A * 12/1934 Cowdery ..... 473/310
2,007,976 A * 7/1935 Kraeuter ..... 473/305
2,039,320 A * 5/1936 Kraeuter ..... 473/309
2,458,920 A * 1/1949 Wheeler et al. ..... 473/306
3,170,691 A * 2/1965 Pritchard ..... 473/306
3,825,991 A * 7/1974 Cornell ..... 29/412
5,462,279 A * 10/1995 Culpepper ..... 473/248
5,851,155 A * 12/1998 Wood et al. ..... 473/246
6,273,828 B1 * 8/2001 Wood et al. ..... 473/246
6,368,230 B1 * 4/2002 Helmstetter et al. ..... 473/244
7,993,213 B1 * 8/2011 D'Eath ..... 473/288
8,042,253 B2 * 10/2011 Su ..... 29/525.14
2002/0037773 A1 * 3/2002 Wood et al. ..... 473/246
2002/0065142 A1 * 5/2002 Okoshi ..... 473/324
2005/0215345 A1 * 9/2005 Kawakami et al. ..... 473/305
2005/0227779 A1 * 10/2005 Lenhof et al. ..... 473/305
2008/0076590 A1 * 3/2008 Hsu ..... 473/244
2008/0119301 A1 * 5/2008 Holt et al. ..... 473/307
2008/0125239 A1 * 5/2008 Clausen et al. ..... 473/307
2009/0062031 A1 * 3/2009 Holtzman ..... 473/307
2009/0075748 A1 * 3/2009 Evans et al. ..... 473/306
2009/0124407 A1 * 5/2009 Hocknell et al. ..... 473/288
2010/0016094 A1 * 1/2010 Hocknell et al. ..... 473/288
2010/0069171 A1 * 3/2010 Clausen et al. ..... 473/288
2010/0120551 A1 * 5/2010 Hocknell et al. ..... 473/288
2010/0181368 A1 * 7/2010 Galloway ..... 228/110.1
2010/0255927 A1 * 10/2010 Evans ..... 473/307
2010/0261543 A1 * 10/2010 Breier et al. ..... 473/307
2010/0323809 A1 * 12/2010 Murphy ..... 473/314
2011/0021282 A1 * 1/2011 Sander ..... 473/288
2011/0039631 A1 * 2/2011 Oldknow et al. ..... 473/314
2011/0118044 A1 * 5/2011 Sato et al. ..... 473/307
2011/0118045 A1 * 5/2011 Sato et al. ..... 473/307
2011/0118046 A1 * 5/2011 Bennett et al. ..... 473/307
2011/0218049 A1 * 9/2011 Oyama ..... 473/307
2011/0250984 A1 * 10/2011 Sato ..... 473/307
2011/0256951 A1 * 10/2011 Soracco et al. ..... 473/307
2011/0306437 A1 * 12/2011 Hocknell et al. ..... 473/288
2011/0312434 A1 * 12/2011 Hocknell et al. ..... 473/288
2012/0052978 A1 * 3/2012 Bennett et al. ..... 473/307
2012/0064990 A1 * 3/2012 Hocknell et al. ..... 473/288
2012/0077615 A1 * 3/2012 Schmidt ..... 473/313
2012/0122604 A1 * 5/2012 Sander ..... 473/307

(Continued)

*Primary Examiner* — Kiley Stoner
(74) *Attorney, Agent, or Firm* — Gonzales Patent Services; Ellen M. Gonzales

(57) ABSTRACT

A novel method for attaching a hosel to a putter head is disclosed. A hosel having a hole is inserted into a putter head cavity and the cavity and hole in the hosel are filled with a fixative configured to permanently attach the hosel shaft to the putter head.

15 Claims, 4 Drawing Sheets

(56) References Cited

U.S. PATENT DOCUMENTS

| | | | | |
|---|---|---|---|---|
| 2012/0149488 | A1* | 6/2012 | Swist | 473/314 |
| 2012/0165112 | A1* | 6/2012 | Bennett et al. | 473/305 |
| 2012/0208653 | A1* | 8/2012 | Sato et al. | 473/307 |
| 2012/0214617 | A1* | 8/2012 | Sato et al. | 473/409 |
| 2012/0225730 | A1* | 9/2012 | De La Cruz et al. | 473/307 |
| 2012/0225731 | A1* | 9/2012 | Suwa et al. | 473/314 |
| 2012/0283044 | A1* | 11/2012 | Sato et al. | 473/409 |
| 2012/0302366 | A1* | 11/2012 | Murphy | 473/314 |
| 2013/0150175 | A1* | 6/2013 | Clausen et al. | 473/288 |
| 2013/0225315 | A1* | 8/2013 | O'Shea et al. | 473/308 |
| 2013/0237340 | A1* | 9/2013 | Mine et al. | 473/309 |
| 2013/0244805 | A1* | 9/2013 | Bolane et al. | 473/307 |
| 2013/0303301 | A1* | 11/2013 | Moore | 473/308 |
| 2013/0324286 | A1* | 12/2013 | Sander et al. | 473/314 |
| 2014/0106894 | A1* | 4/2014 | Murphy | 473/314 |

* cited by examiner

METHOD FOR ATTACHING THE HOSEL TO A PUTTER HEAD

BACKGROUND

It is often desirable for golfers to customize their putters. For example, a particular may want to pair a specific style of putter head with a specific style of hosel. Accordingly, manufacturers of custom golf clubs need to be able to attach different styles of hosels to different styles of putter heads. However, attaching the hosel to a putter head is one of the most difficult and time consuming parts of making hand tooled putters. It is important that the hosel be attached to the putter head with sufficient strength that the golf club can withstand repeated strikes. Previous methods of Furthermore, because feel is perhaps the most important aspect of putting, is it is important that vibration of the shaft during a ball strike be reduced or preferably eliminated. Accordingly, it is an object of the present disclosure to provide a method for attaching a hosel to a putter head that is both efficient from a time perspective and sufficient to provide the appropriate amount of feel to the golfer.

SUMMARY

The present disclosure provide a method for attaching a hosel to a putter head that is both efficient from a time perspective and sufficient to provide the appropriate amount of feel to the golfer.

DETAILED DESCRIPTION

According to an embodiment the present disclosure provides a method for attaching a metal hosel to a metal putter head. According to an embodiment, a putter head is provided having a cavity with a single opening that exposes two adjacent faces of the putter head. The first exposed face is the top surface from which the hosel shaft will extend, the second exposed face may be, for example, the rear face of the putter. In alternate embodiments the second exposed surface could be, for example, the heel end of the putter head, or even the striking surface of the putter, though this may be less desirable in some cases. A hosel, having a hole drilled, or otherwise formed, through the end of the shaft in inserted into the cavity so that the hole in the hosel shaft reveals a portion of the inner surface of the side of the cavity that is opposite to the second exposed face. The hosel shaft hole and the portion of the cavity not filled by the hosel are then filled with a fixative configured to permanently attach the hosel shaft to the putter head. This may be accomplished, for example, by soldering or welding. According to some embodiments, the cavity is overfilled so as to produce a nub on the outer surface of the second face. This nub may be removed using appropriate means. For example, where the pieces have been soldered or welded, the resulting metal nub may be machined off to form a flat, smooth, surface.

Figure 1:
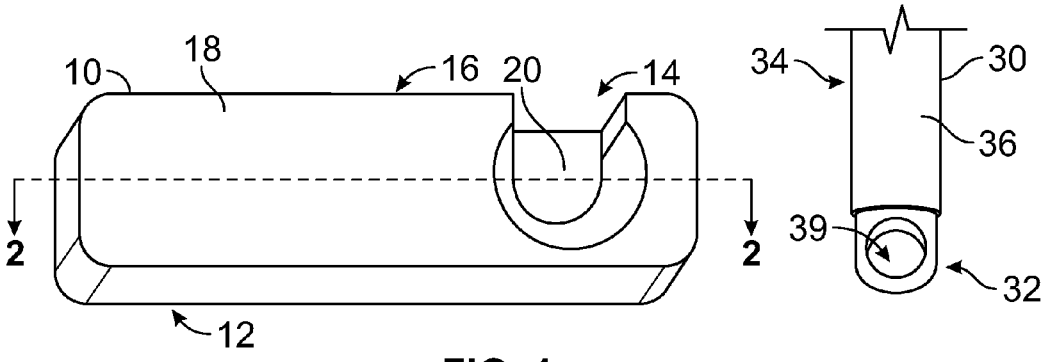
FIG. 1 is a side view of a putter head and unattached hosel.

Turning to FIG. 1, a preformed putter head 10 having a striking surface 12 and an unattached hosel 30 are shown. Preformed putter head 10 includes a cavity 14 which exposes both the top 16 and back side 18 of the putter head. For ease of description, the proximal end 32 and distal end 34 of the hosel shaft are identified in the figures. Cavity 14 may be formed, for example, by drilling. The cavity is generally sized to receive the proximal end of hosel 30 and allow the hosel shaft 36 to extend out of the top 16 of the putter head. As shown, cavity 14 includes an inner surface 20.

Figure 2:
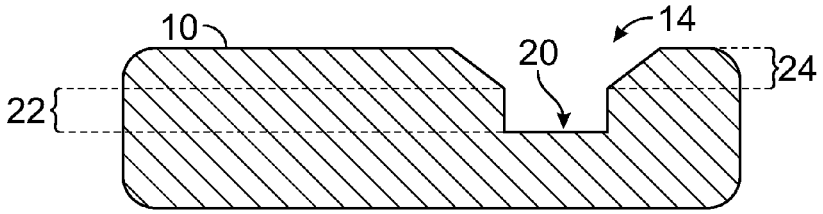
FIG. 2 is a cross-section of the putter head taken along 1-1.

As stated earlier, it is important that the attachment of the hosel to the putter head be very strong. Accordingly, in some embodiments, the cavity is formed so as to increase the surface area that is available for the fixative to attach to. A cross-section of cavity 14 is shown in FIG. 2. In the depicted embodiment, cavity 14 has a narrow section 22, which then opens into a tapered outer rim section 24.

Figure 3:
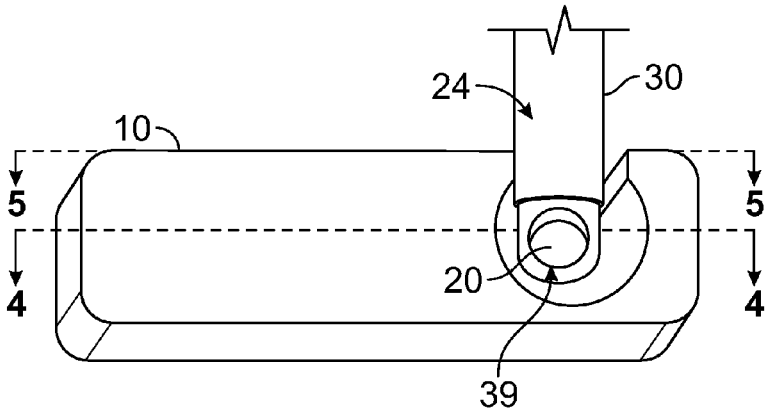
FIG. 3 is a side view showing the hosel inserted into the cavity in the putter head.
Figure 4:
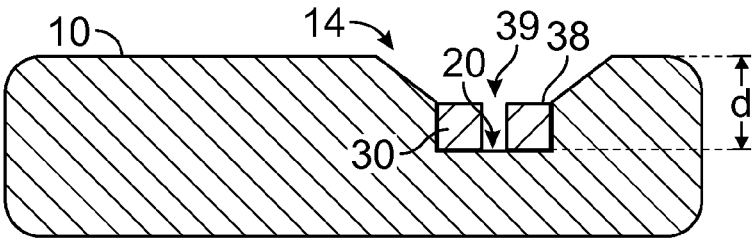
FIG. 4 is a cross section of FIG. 3 taken along 4-4.

As seen best in FIGS. 3 and 4, when the proximal end of the hosel is inserted into the cavity, the top edge 38 (as viewed in FIG. 4) of the hosel seats within the narrow section of cavity 14 and is more or less flush with the bottom of the shallow tapered outer rim section.

It will be understood that the cavity depth d (as measured from the inner surface that is revealed by the hole in the hosel shaft to the edge of the second exposed face) may be determined by the desired placement of the hosel. For example, if the second exposed face is the back of the club (i.e. the surface opposite the striking surface) as shown in the depicted embodiment, the depth of the cavity can determine whether the hosel extends upwards from the centerline of the club, or is displaced towards or away from the putter face. Alternatively, if the second exposed face is the heel of the club, the depth of the cavity can be used to place the hosel in the desired toe-to-heel position.

Furthermore, it can also be seen that when the proximal end of hosel 30 is inserted into cavity 14, a portion of inner surface 20 remains exposed through the hole 39 in hosel 30.

Figure 5:
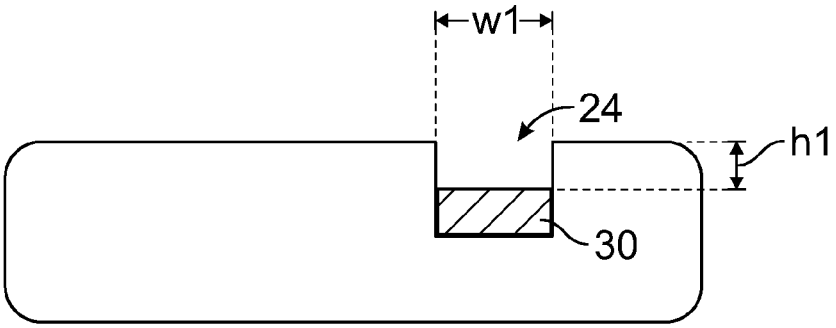
FIG. 5 is a cross section of FIG. 3 taken along 5-5.

According to an embodiment of the method for attaching the hosel 30 to the putter head 10, the hosel 30 is inserted into cavity 14 such that the proximal end of the hosel is seated within the narrow section of the cavity and a portion of wall 20 is exposed through hole 39. As shown, this creates a partial well having an open side 24. The open side has a width w1 and a height h1. See FIG. 5.

Figure 6:
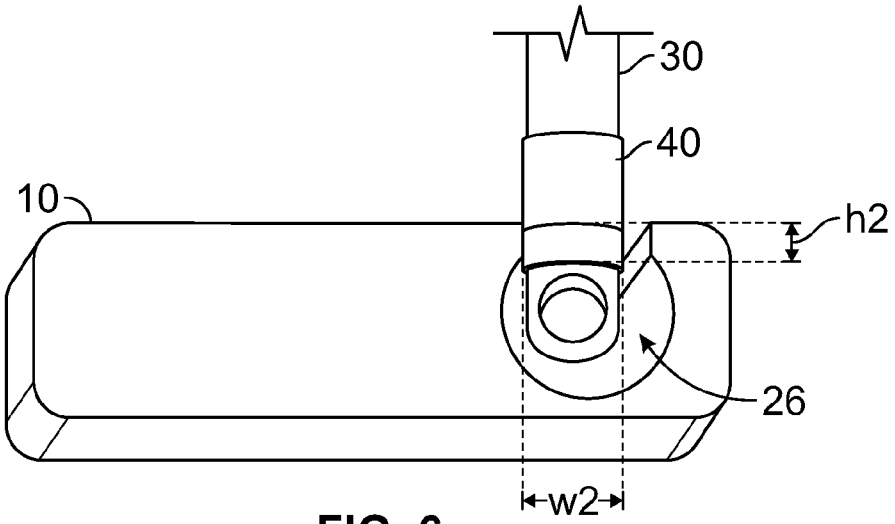
FIG. 6 is a side view showing a dam piece positioned to as to form a walled well with the putter head and hosel.
Figure 7:
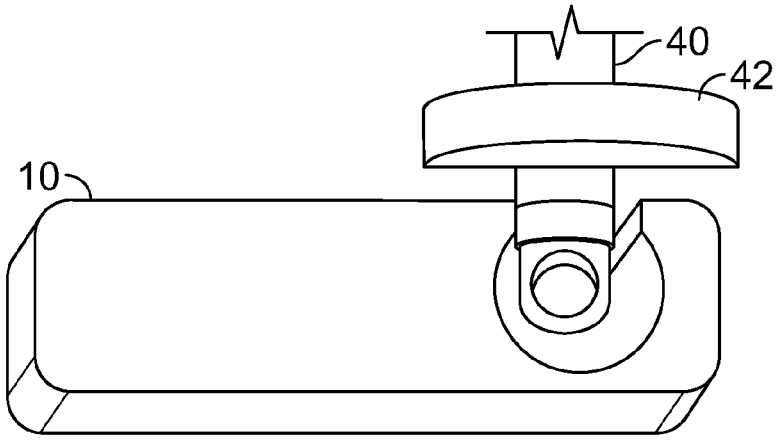
FIG. 7 is a side view showing the dam piece clamped in place.
Figure 8:
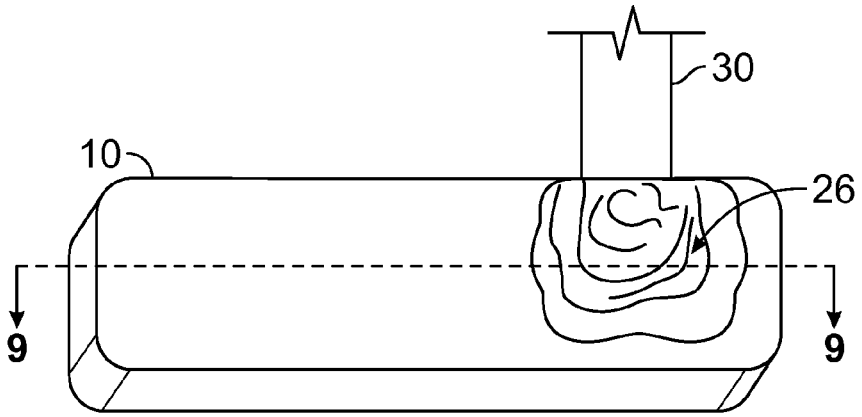
FIG. 8 is a side view showing the nub formed from overfilling the well. The dam piece has been removed.

Turning now to FIG. 6, a dam piece 40 having a width w2 that is equal to or greater than w1 and a height h2 is then placed against the edge 38 of hosel 30 so as to create a barrier at opening 24, and thereby forming a complete well 26. As shown in FIG. 8, the dam piece may then be removably held in place, for example by a clamp 42 or other sufficient means.

Figure 9:
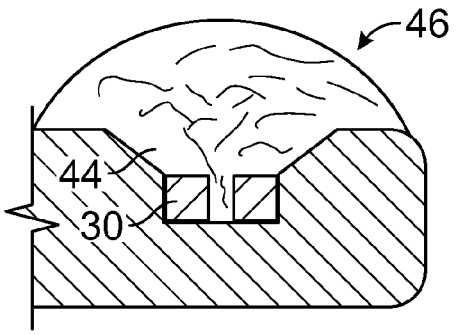
FIG. 9 is a cross section of FIG. 8 taken along 9-9.
Figure 10:
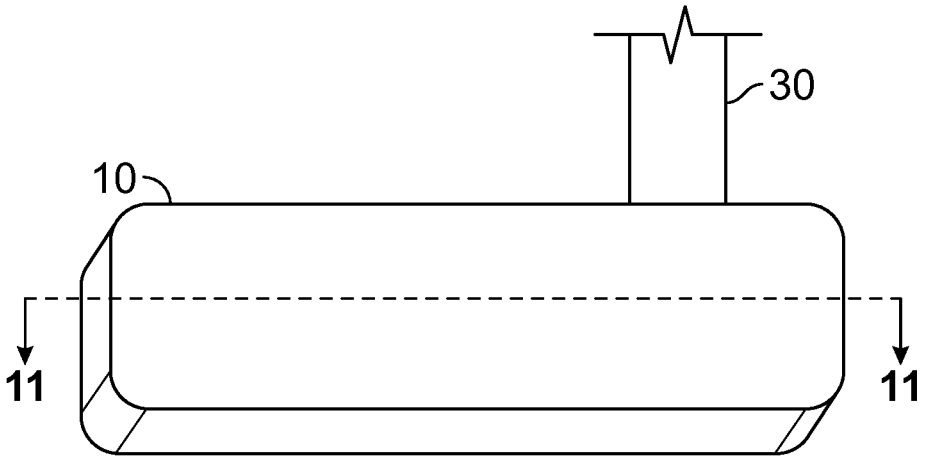
FIG. 10 is a side view showing the putter with the hosel attached.
Figure 11:
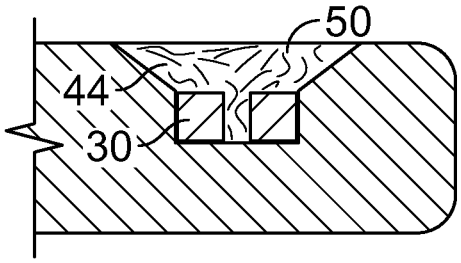
FIG. 11 is a cross section of FIG. 10 taken along 10-10.

Turning to FIGS. 8 and 9, according to the presently described method, the hosel is then permanently attached to the putter head by overfilling well 26 with a fixative 44. According to a preferred embodiment, the fixative is a liquid metal that is introduced into the well and allowed to harden using standard soldering or welding techniques. The dam piece is then removed and the left-over nub 44 is machined off to produce a smooth surface, as shown in FIG. 10. FIG. 11 is a cross-section of the finished club head of FIG. 10, showing the smooth finished surface 50, the hardened fixative 44, and the now permanently attached hosel 30.

The resulting putter has a strong attachment point that is capable of withstanding repeated strikes while maintaining excellent feel. Furthermore, the method is substantially faster than previous methods—allowing for a four time increase in production.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. The methods and processes illustratively described herein suitably may be practiced in differing orders of steps, and that they are not necessarily restricted to the orders of steps indicated herein or in the claims. As used herein and in the appended claims, the singular forms "a," "an," and "the" include plural reference unless the context clearly dictates otherwise. Thus, for example, a reference to "a host cell" includes a plurality (for example, a culture or population) of such host cells, and so forth.

Under no circumstances may the patent be interpreted to be limited to the specific examples or embodiments or methods specifically disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

What is claimed is:

1. A method of attaching a hosel to a golf club head having a top surface comprising:

providing a golf club head having a top surface, a back, a toe, and a longitudinal center line;

forming a cavity in the golf club head that simultaneously exposes two adjacent surfaces of the golf club head, wherein one of the exposed edges is the top surface of the club head;

forming a tapered outer rim section in the exposed surface that is adjacent to the exposed top surface;

providing a hosel comprising a hosel shaft with a proximal end and a distal end, wherein the hosel shaft has a hole at the proximal end seating the proximal end of the hosel shaft within the cavity such that the shaft extends out of the top surface of the club head and the hole in the hosel exposes a wall of the cavity; wherein when the hosel is seated within the cavity, the tapered outer rim section and hole in the hosel shaft form a partial well having a side opening;

placing a removable element across the side opening so as to form a complete well; and filling the complete well with a fixative configured to permanently attach the hosel to the golf club head.

2. The method of claim 1 further comprising removing any fixative that overfills the well.

3. The method of claim 1 wherein the step of filling the well with a fixative comprises soldering or welding.

4. The method of claim 1 further comprising removing the removable element.

5. The method of claim 1 wherein the exposed surface that is adjacent to the exposed top surface is the back of the putter head.

6. The method of claim 1 wherein the exposed surface that is adjacent to the exposed top surface is the toe of the putter head.

7. The method of claim 5 wherein the cavity has a depth that is sufficient to place the shaft of the hosel perpendicular to the longitudinal center line of the putter head.

8. A method of attaching a hosel to a golf club head comprising:

providing a hosel having a hosel shaft, wherein a hole is drilled through the proximal end of the hosel shaft;

providing a golf club head having a top surface and a cavity that simultaneously exposes the top surface of the club head and a surface adjacent to the top surface of the club head, so as to provide an inner surface;

seating the hosel within the cavity such that the shaft extends out of the top surface of the club head and wherein the hole in the hosel shaft exposes a portion of the inner surface of the cavity; and filling the hole in the hosel shaft and the cavity with a fixative via soldering or welding such that the hosel is permanently attached to the golf club head.

9. The method of claim 8 wherein the cavity is shaped such that when the hosel is seated within the cavity, a partial well is formed.

10. The method of claim 9 wherein the partial well has outwardly sloping edges.

11. The method of claim 9 further comprising placing a removable element adjacent to the partial well so as to form a completed well.

12. A method of attaching a hosel to a golf club head comprising:

providing a hosel having a hosel shaft with a proximal end, wherein a hole is drilled through the proximal end of the hosel shaft;

providing a golf club head having a top surface and a cavity that is shaped such that when the hosel is seated within the cavity, a partial well having outwardly sloping edges is formed and wherein the cavity simultaneously exposes the top surface and a surface adjacent thereto;

seating the hosel within the cavity such that the shaft extends out of the top surface of the club head and the hole in the hosel shaft exposes a portion of the inner surface of the cavity;

placing a removable element adjacent to the partial well so as to form a completed well; and filling the hole in the hosel shaft and the well with a fixative such that the hosel is permanently attached to the golf club head.

13. The method of claim 12 wherein the step of filling the hole in the hosel shaft and the well with a fixative comprises soldering or welding.

14. The method of claim 12 further comprising removing the removable element.

15. The method of claim 11 further comprising removing the removable element.

* * * * *